United States Patent [19]

Shulyak

[11] Patent Number: 5,044,507

[45] Date of Patent: Sep. 3, 1991

[54] COLLAPSIBLE DRYING RACK

[76] Inventor: Lev A. Shulyak, 22 Buckley Rd., Worcester, Mass. 01602

[21] Appl. No.: 550,312

[22] Filed: Jul. 9, 1990

[51] Int. Cl.[5] ..... D06F 57/08

[52] U.S. Cl. ..... 211/203; 211/205; 248/431

[58] Field of Search ..... 211/203, 195, 205, 196, 211/119.01, 119.1; 248/431, 164

[56] References Cited

U.S. PATENT DOCUMENTS

| | | | |
|---|---|---|---|
| 22,804 | 2/1859 | Henshaw . | |
| 29,599 | 8/1860 | Johnson . | |
| 29,870 | 9/1860 | Fickett . | |
| 94,182 | 8/1869 | Butler . | |
| 101,999 | 4/1870 | Haines . | |
| 250,878 | 12/1881 | Brush . | |
| 583,013 | 5/1897 | Ebert . | |
| 587,391 | 8/1897 | Gandy | 248/431 X |
| 1,241,987 | 10/1917 | Kalisz . | |
| 1,243,216 | 10/1917 | Price | 211/203 |
| 1,295,265 | 2/1919 | Bradley . | |
| 1,643,271 | 9/1927 | Hansen . | |
| 1,896,446 | 2/1933 | Goeller | 248/431 X |
| 2,710,733 | 6/1955 | Phillips . | |
| 4,290,532 | 9/1981 | Reynolds . | |
| 4,496,615 | 1/1985 | Huang | 211/205 X |

*Primary Examiner*—Reinaldo P. Machado
*Attorney, Agent, or Firm*—Albert W. Hilburger

[57] ABSTRACT

A collapsible rack for drying clothing and other articles is comprised of a plurality of leg members pivotally mounted on a core member and held thereon by an elastic band member which encircles them intermediate upper and lower ends. The core member is provided with a plurlity of equally spaced stop members extending radially outwardly from a central axis. The leg members are movable between collapsed positions at which each is engageable with an associated stop member and extended positions at which the rack is free standing on the lower ends of the leg members. Flexible cord material of substantially equal length extends between each successive leg memebr and is joined to the leg members at similar distances away from the core member. When the leg members are collapsed, they are substantially parallel and the cord material is limp; when extended, they are angularly disposed relative to the central axis such that the cord material is taut, thereby providing support for articles to be dried. A net may be releasably mounted to the upper ends of the leg members so as to overlie the rack and provide surface area for supporting still more articles to be dried.

25 Claims, 6 Drawing Sheets

COLLAPSIBLE DRYING RACK

BACKGROUND OF THE INVENTION

A. Field Of The Invention

The present invention concerns improvements in collapsible racks used for drying clothing and other fabric articles.

B. Description Of The Prior Art

In the nineteenth century, collapsible free-standing frames for drying clothes and the like were popular. Examples of these constructions which reflected the materials and techniques of that time are presented in Ser. No. 22,804 to Henshaw; No. 29,599 to Johnson; Ser. No. 29,870 to Fickett; Ser. No. 94,182 to Butler; and Ser. No. 101,999 to Haines.

While such devices served well their intended purposes for that period of our history, they eventually fell into disfavor, being replaced first by multiple outdoor clotheslines, then, more recently, by modern appliances in the form of gas and electric dryers for drying articles indoors.

However, there has been a re-emergence of drying racks of the collapsible or folding variety. This new interest in the broad concept has occurred for a number of reasons. A primary cause for this change in attitudes is the fairly recent emphasis on conservation of energy and natural resources which has resulted in some reluctance on the part of members of the public to use electric or gas powered appliances when natural means are available. Ecological considerations, particularly, concern for pollution of the atmosphere by reason of fossil fuels, have also had a similar effect.

In another vein, space limitations, such as those experienced in apartments and condominiums, have caused their occupants to seek appliances, furniture, and similar items which utilize space in an efficient manner. Items which can be folded away when not in use, but are readily available for use in a manner similar to their noncollapsible counterparts are regularly being sought.

Additionally, while automatic dryer appliances of the gas and electric variety have become almost indispensible for the drying of articles rapidly and, particularly, in inclement weather, they are not particularly effective for drying bulky items such as sweaters, pillows, heavy comforters, and the like. For such items, natural drying processes in the open air are most desirable.

Also, camping and the widespread use of mobile homes have also given rise to foldable appliances and furniture. Particularly desirable for campers and mobile home users would be an energy efficient, light weight, collapsible rack which could be used for drying newly laundered clothes or articles which have become damp from use.

There is also a substantial variety of known constructions for foldable articles other than drying racks. In this regard, U.S. Pat. No. 250,878 to Brush; U.S. Pat. No. 583,013 to Ebert; U.S. Pat. No. 1,241,987 to Kalisz; U.S. Pat. No. 1,643,271 to Hansen; and U.S. Pat. No. 2,710,733 to Phillips all disclose foldable stands for supporting table tops, wash tubs, and similar appliances. Patent U.S. Pat. No. 1,295,265 to Bradley discloses a foldable hay stacking rack; and U.S. Pat. No. 4,290,532 to Reynolds discloses a foldable two dimensional support assembly intended for a plurality of clothes lines.

SUMMARY OF THE INVENTION

It was in light of the prior art as just described that the present invention has been conceived and is now reduced to practice. To this end, the present invention relates to a modern collapsible rack for drying clothing and other fabric articles comprised of a plurality of leg members pivotally mounted on a core member and held thereon by an elastic band member which encircles them intermediate upper and lower ends. The core member is provided with a plurality of equally spaced stop members extending radially outwardly from a central axis. The leg members are movable between collapsed positions at which each is engageable with an associated stop member and extended positions at which the rack is free standing on the lower ends of the leg members. Flexible cord material of substantially equal length extends between each successive leg member and is joined to the leg members at similar distances away from the core member. When the leg members are collapsed, they are substantially parallel and the cord material is limp; when extended, they are angularly disposed relative to the central axis and draw the cord material taut, thereby providing support for articles to be dried. A central extension pole may be releasably attached to the core member. Hanger members may be provided on the extension pole and on the leg members for suspending yet more articles to be dried. A net may also be releasably mounted to the upper ends of the leg members so as to overlie the rack and provide surface area for supporting still more articles to be dried.

The invention utilizes modern and inexpensive materials and is extremely light in weight. It readily retracts to a highly compact configuration for storage and selectively extends to a large configuration for drying a maximum possible load of articles. It is of simplified construction, and can be readily assembled, and if components break, they can be readily and inexpensively replaced.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings, which are incorporated in and constitute a part of the invention, illustrate various embodiments of the invention and, together with the description, serve to explain the principles of the invention in general terms. Throughout the disclosure, like numerals refer to like parts.

DETAILED DESCRIPTION OF THE PREFERRED EMBODIMENTS

Figure 1:
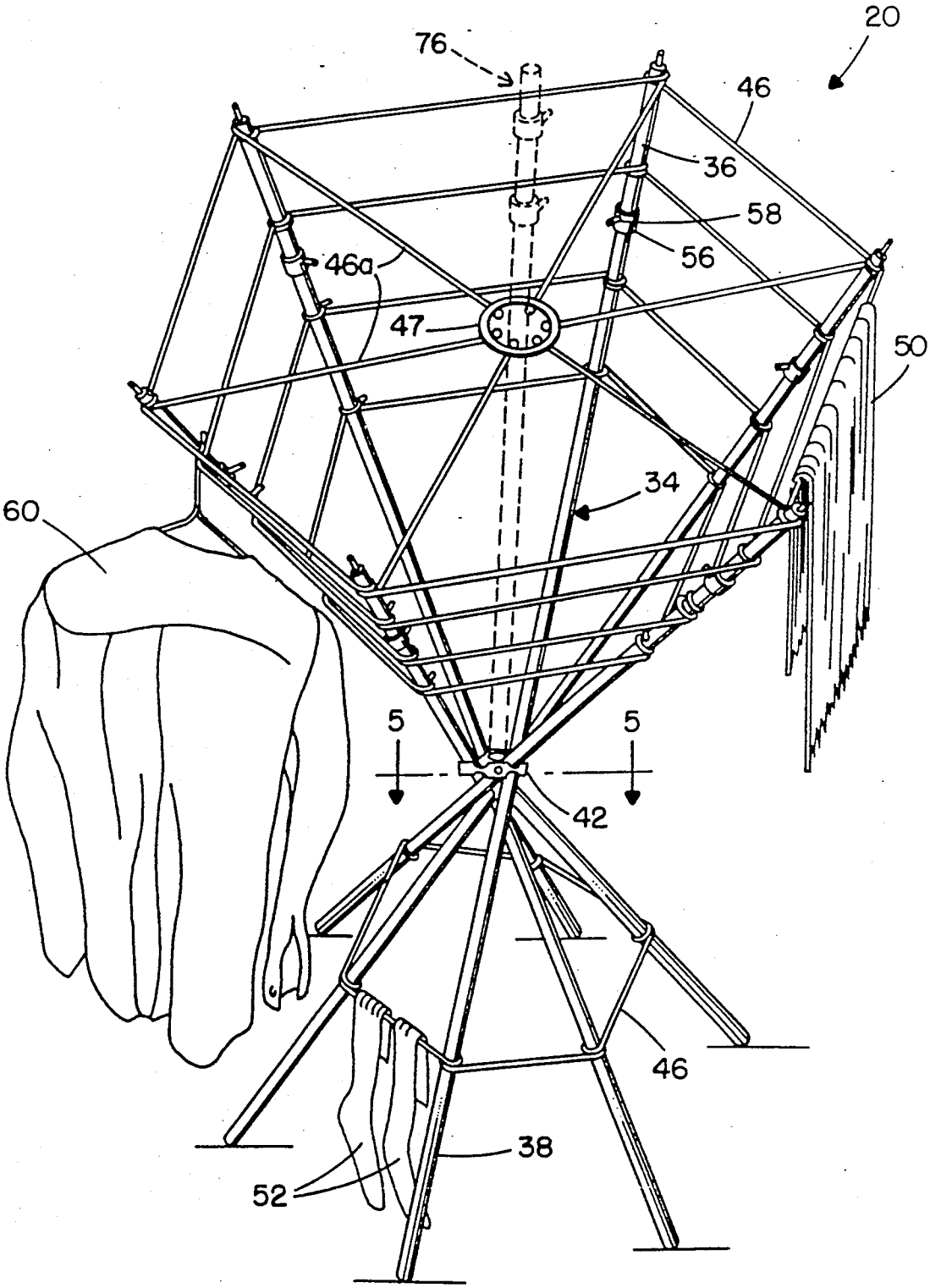
FIG. 1 is a perspective view of a drying rack embodying the present invention.
Figure 2:
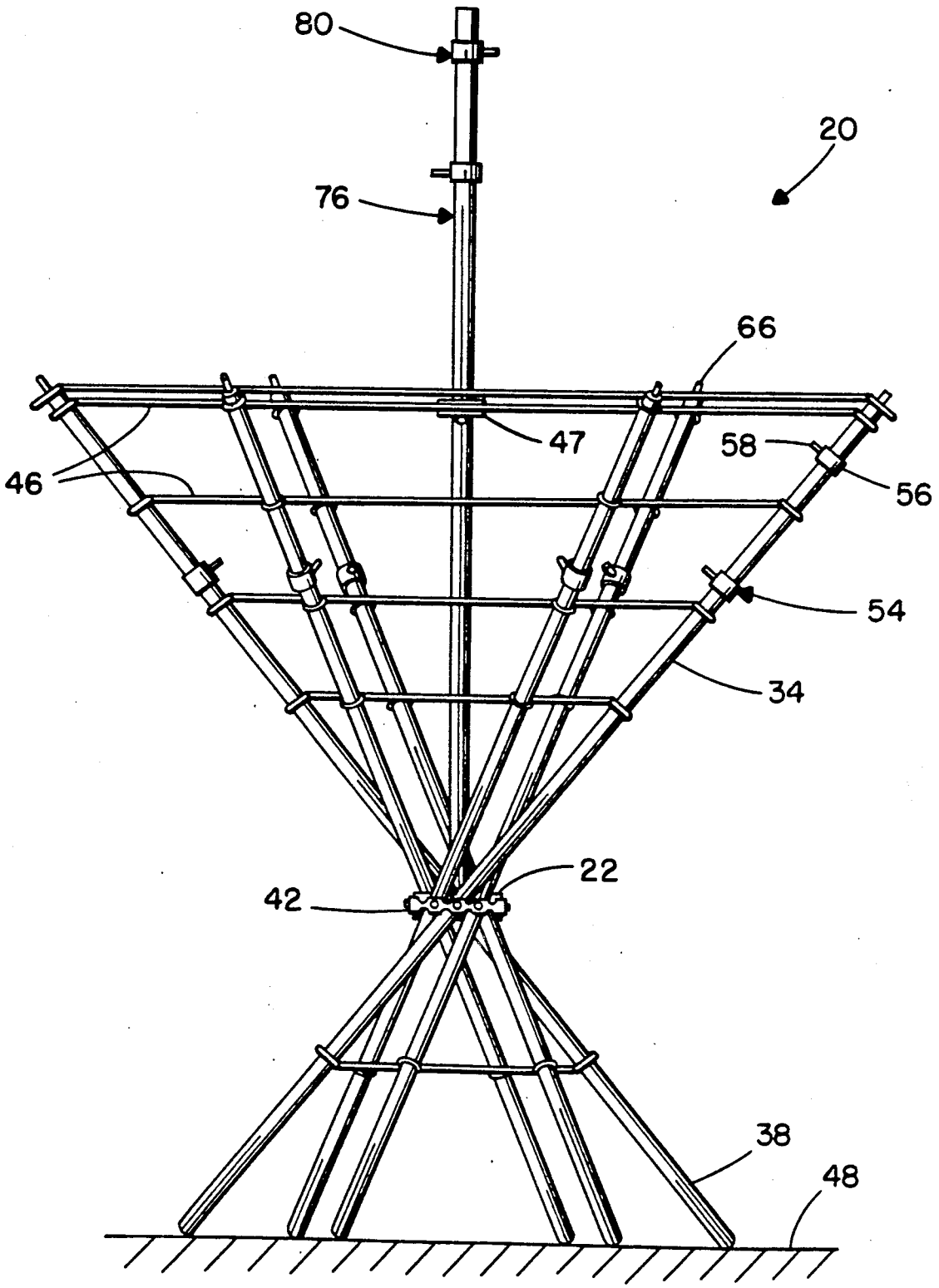
FIG. 2 a side elevation view of the drying rack of invention illustrated in FIG. 1.
Figure 3:
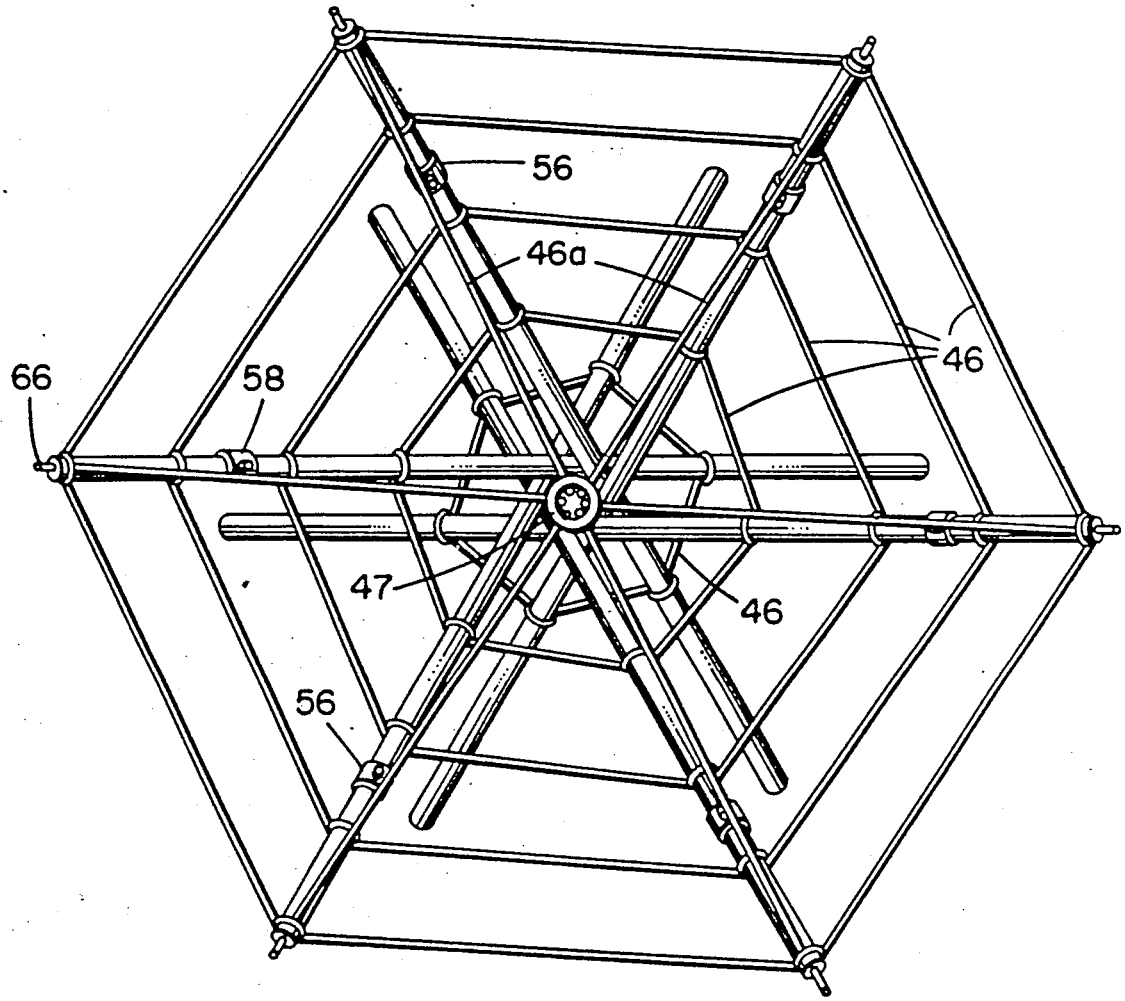
FIG. 3 a top plan view of the drying rack of the invention.
Figure 6:
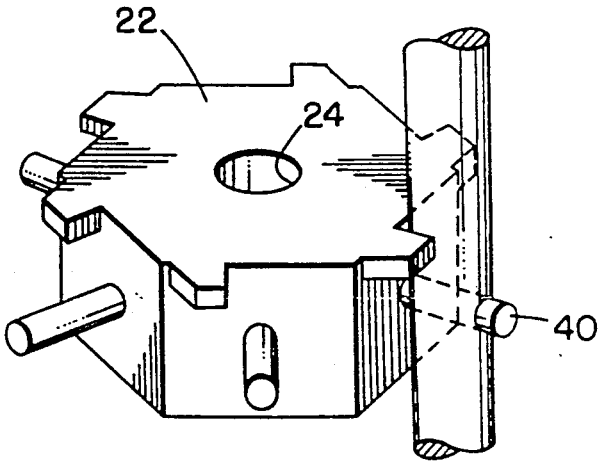
FIG. 6 is a perspective view of the components illustrated in FIGS. 4 and 5.
Figure 4:
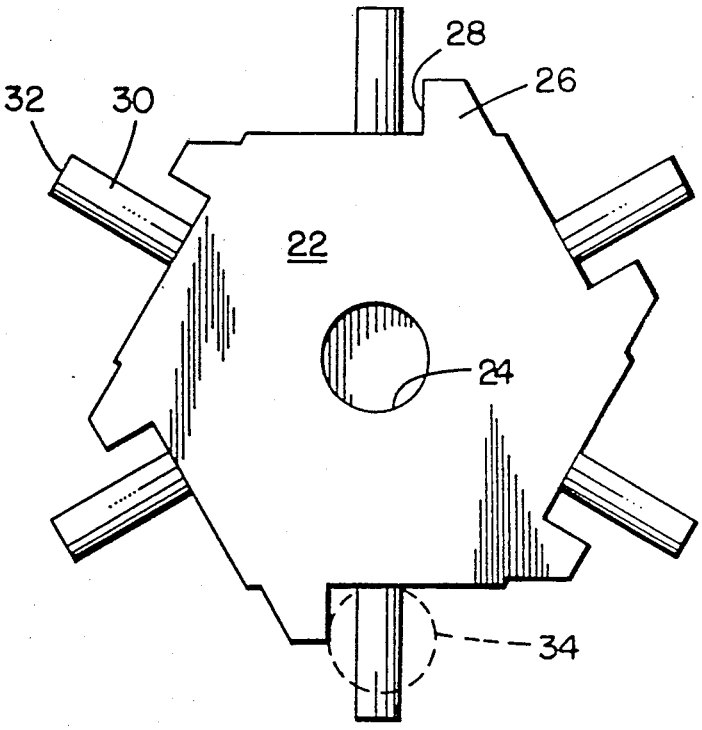
FIG. 4 a detail top plan view depicting certain of the invention.
Figure 5:
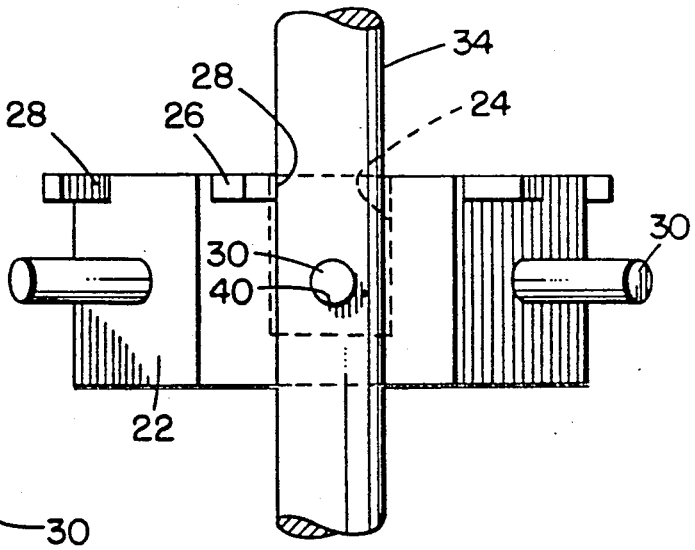
FIG. 5 is a side elevation view of the component in FIG. 4.

Turn now to the drawings and, initially, to FIGS. 1, 2, and 3 which depict a collapsible drying rack 20 embodying the invention. As best seen in FIGS. 4, 5, and 6, the drying rack 20 is provided with a core member 22 which has a central axis which is the axis of a central bore or recess 24 therein. A plurality of stop members 26 extend generally radially outwardly from the central axis of the core member 22 at equally spaced peripheral locations. Each stop member 26 is provided with a stop surface 28 which lies in a plane parallel with, but spaced from, a radial plane passing through the central axis of the core member.

A plurality of mounting pins 30 are suitably fixed to the core member 22 at equally spaced peripheral locations adjacent to each of the stop members 26 and spaced from its associated space 28. The mounting pins 30 extend radially outwardly from the core member and their axes lie within radial planes of the nature mentioned above. The mounting pins 30 terminate at tip ends 32 and lie substantially in a plane perpendicular to the central axis of the core member 22.

A plurality of elongated leg members 34 of identical length, which may be of solid or tubular construction, extend between upper and lower ends, 36 and 38, respectively. Viewing FIGS. 5 and 6, each leg member 34 is formed with a diametrically extending bore 40 located intermediate the upper and lower ends 36, 38, and the bore 40 is positioned at the same distance from the ends 38, 40 for all of the leg members. The bore 40 is of a diameter to enable each of the leg members 34 to be pivotally mounted on the mounting pins 30. Thus, the bore 40 is preferably chosen to be slightly larger than that of its associated mounting pin 30.

Figure 7:
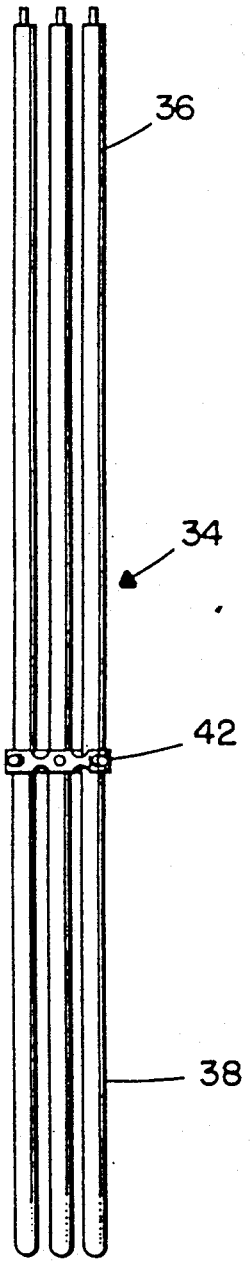
FIG. 7 is a side elevation view illustrating certain ,components of the invention illustrated in FIGS. 1 and 2 but in their collapsed positions.

Being pivotally mounted on the pins 30, the leg members 34 are movable between collapsed positions as depicted in FIG. 7 and extended positions as indicated in FIGS. 1, 2, and 3. When each of the leg members is in its collapsed position, its longitudinal axis is substantially parallel to the central axis of bore member 22 and it is in engagement with the stop surface 28 of its associated stop member 26. This can best be seen in FIGS. 5 and 6. However, when each of the leg members 34 assumes the extended position as depicted in FIGS. 1, 2, and 3, it is disengaged from its associated one of the stop members 26 and is angularly disposed relative to the central axis of the core member 22.

Figure 8:
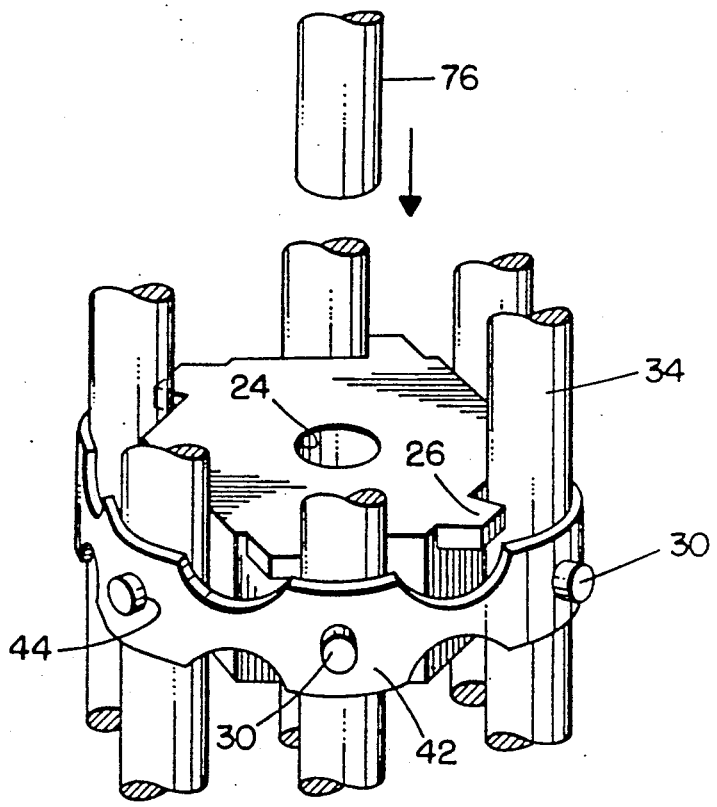
FIG. 8 is a detail perspective view, partly exploded, illustrating a portion of the drying rack depicted in FIGS. 1 and 2.

A retention member is provided for holding the leg members 34 in firm engagement with the core member 22 and is preferably in the form of an elastic band 42 best seen in FIG. 8. The band 42 is provided with a plurality of spaced apertures 44, located and sized for snug reception of each of the mounting pins 30. The band 42 may be endless in which case it is so sized that it can be enlarged hoop-wise for initial attachment, or subsequent removal or replacement, but is capable of imparting a sufficient force on each of the leg members 34 to hold it firmly in engagement with the core member 22. At the same time, the band 42 must permit unhindered movement of the leg members 34 between their collapsed (FIG. 7) and extended (Figures 1-3) positions.

Figure 11:
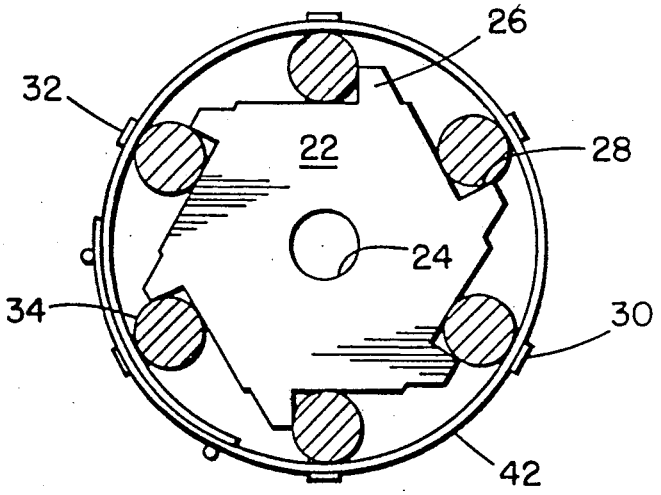
FIG. 11 is a top plan view of certain components of a modified embodiment of the invention.
Figure 9:
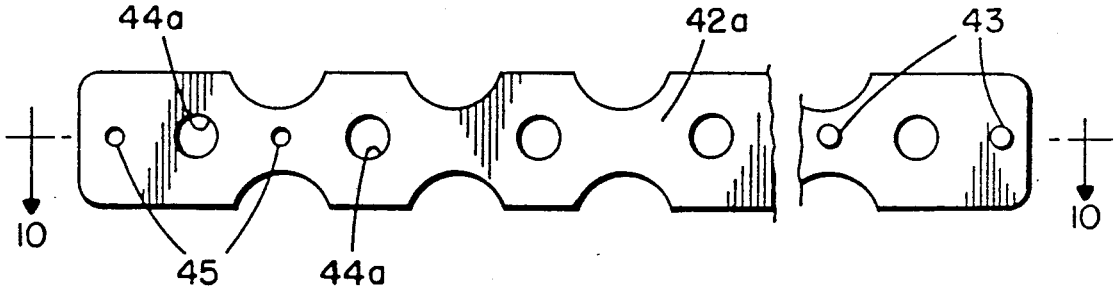
FIG. 9 is a top plan view illustrating another component of the invention.
Figure 10:
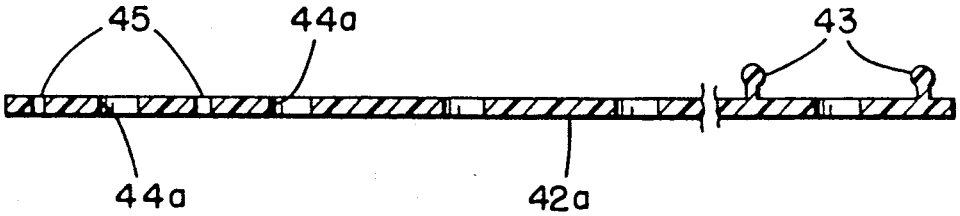
FIG. 10 is a cross section view taken generally along line 10—10 in FIG. 9.

However, in a preferred construction, illustrated in FIG. 9, 10, and 11, a band 42*a* of finite length is employed. The band 42*a* has a plurality of longitudinally spaced apertures 44*a* (FIGS. 9 and 10), also located and sized for snug reception of each of the mounting pins 30. A pair of retention pegs 43 with enlarged heads are mounted to and project from one surface of the band 42*a*, straddling the last aperture 44*a* at one end of the band. The opposite end of the band 42*a* has a pair of holes 45 straddling the last aperture 43*a* spaced and sized to fittingly receive the retention pegs 43 when the band is drawn into a circle such that the ends of the band are caused to overlap. This situation is illustrated in FIG. 11. As seen in FIG. 11, the apertures 44*a* at opposite ends of the elastic band 42*a* are received on the same mounting pin 30 and the adjacent pegs are force-fitted into their associated holes 45. In this condition, the band 42*a* is reasonably stressed to firmly hold the leg members 34 in engagement with the core member 22.

Flexible elongate material in the form of strands 46 of nylon or other suitable material extend between each successive one of the leg members 34. The strands are of substantially equal length and form a continuous band attached to each successive leg member 34 at substantially the same distance from an end thereof. Preferably, there are several of these loops attached to the respective leg members 34 at different distances from the ends of the leg member, with each loop being attached to the successive leg members at a specified distance from the end of the leg. The opposite ends of each strand may be tied to adjacent leg members 34 or, preferably, each strand would merely part of an elongated loop which would circumscribe all of the legs 34 and encircle each of the individual leg members. The free ends of the larger loop member would then be joined at a proper location. A plurality of the strands 46 and their associated loops are preferably positioned in various parallel, spaced apart, planes as seen particularly well in FIGS. 1 and 2.

Additionally, a plurality of radial strands 46*a* are provided extending between the upper ends 36 of the leg members 34 and a centrally located ring 47. The strands are attached in any suitable manner to the upper ends 36 and to the ring 47.

It will be appreciated that when the leg members assume an extended position such that their lower ends 38 are supported on a surface 48 (see FIG. 2), the strands 46 and 46*a* define the limits of the extended position for the drying rack 20. Thus, the stop members 26 define the collapsed position of the drying rack 20 while the strands 46 define its extended position. With the leg members 34 in their extended positions, the strands 46 and 46*a* are held taut such that they are capable of supporting a variety of articles which are wet and require drying. In typical fashion, FIG. 1 depicts a towel 50 hung from one of the strands 46 and a pair of socks 52 hung from another of the strands. As illustrated in FIG. 2, the lowermost ends of the leg members 34 are rounded, as indicated at 53, to assure optimal reception with the supporting surface 48.

Figure 12:
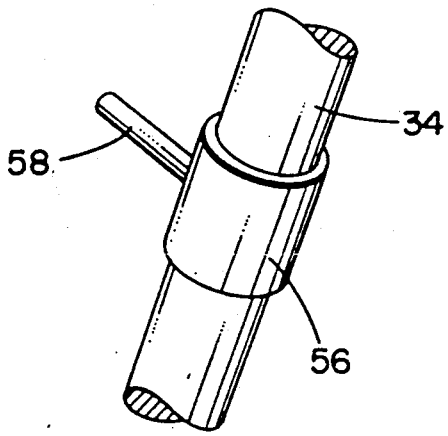
FIG. 12 is a detail perspective view illustrating another subcomponent of the invention.

In order to enlarge the capacity of the drying rack 20, a plurality of hangers 54 may be provided at spaced locations along the leg members 34. As particularly well seen in Figure 12, each hanger 54 includes a ring member 56 which is snugly or fittingly received on the leg member 34. A peg member 58 is integral with each ring member 56 and extends radially outwardly therefrom and when mounted on a leg member 34 also extends generally in the direction of the axis of the core member 22. In this manner, the hangers 54 do not offer any undesirable projections which could catch the clothing or accouterments of persons moving in the vicinity of the drying rack. At the same time, as seen in FIG. 1, they can supportively receive the hooks of clothes hangers and the like, a shirt 60 being illustrated as being supported in such a manner.

A plurality of cross strands 62 of flexible elongate material, similar to strands 46, may extend between opposed leg members at their uppermost ends. When the leg members are in their extended positions, the cross strands 62 would be drawn taut in the same manner as the strands 46. When so positioned, they are capable of supporting a variety of articles to be dried and efficiently utilize the interior volume of the drying rack for this purpose.

Figure 13:
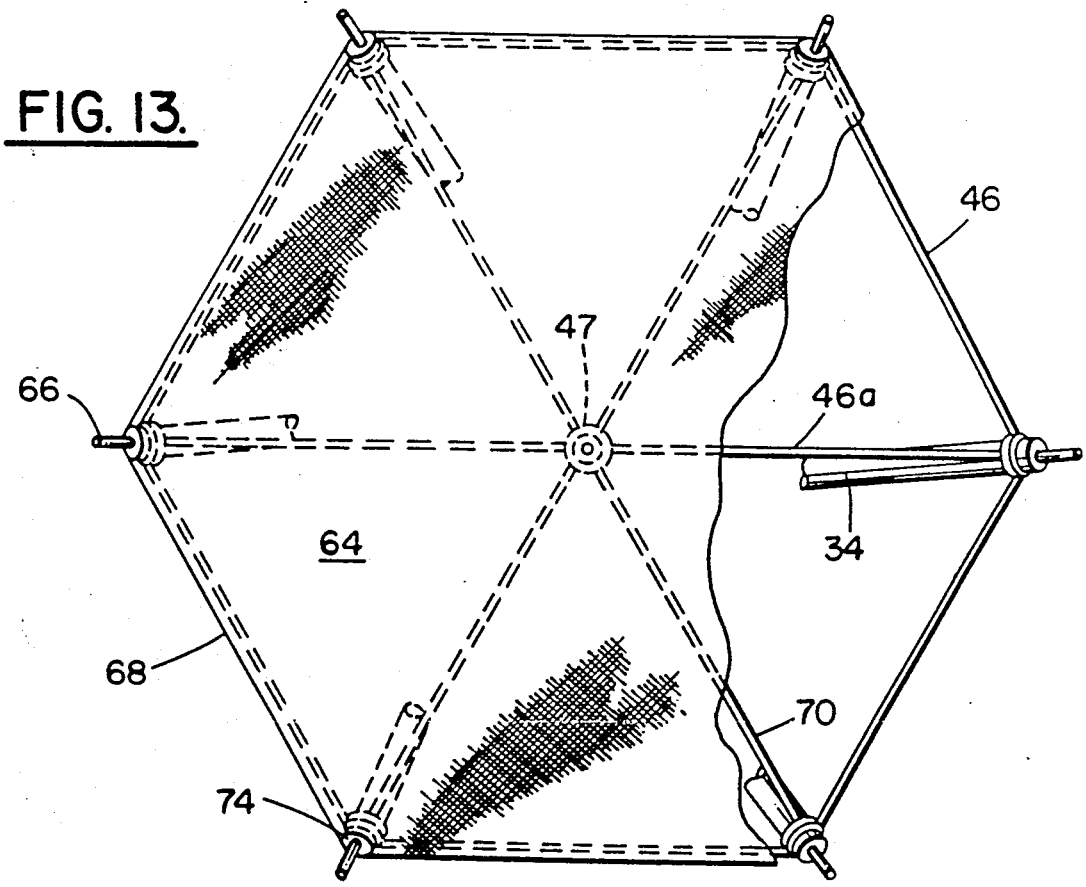
FIG. 13 is a top plan view, certain parts being cut away(; of the drying rack of the invention, and illustrating another embodiment thereof.

Still another expedient for increasing the capacity of the drying rack 20 is illustrated in FIG. 13. In this instance, a net member 64 which may be, for example, of woven nylon or other suitable, preferably fast drying, fabric material is mounted to the drying rack 20 so that it overlies its uppermost regions, supported on the strands 46*a*. Specifically, the upper ends of the leg members 34 include an integral upper peg member 66 extending in a direction away from its lower end. The net member 64 is used whenever it is desired to provide a substantially horizontal supporting surface for articles to be dried. Although it would be the choice of each individual user of the drying rack 20, it would be possible for items to be hung from the cross strands 46*a* while simultaneously using the net member 64 for still other items.

As seen particularly well in FIGS. 1, 2, and 8, the drying rack 20 may also be provided with an extension pole 76 releasably mounted to the core member 22. Viewing FIG. 8, it is seen that the lowermost end of the extension pole is slidably received within the bore 24. Hangers 80, which may be similar in construction to the hangers 54, may be similarly mounted on the extension pole at spaced locations along its length. In this manner, the extension pole 76 can add still further capacity to the drying rack 20, especially for hanging long items.

It was previously explained with particular attention to FIGS. 5 and 7 that when the leg members 34 are in the collapsed position, they are substantially parallel to one and other and to the central axis of the core member 22. In this regard, it will be appreciated that by reason of the stop members 26, when it is desired to open the drying rack to its extended position, the leg members 34 are permitted to pivot only in a clockwise direction about their mounting pins 30. That is, the construction of the drying rack does not permit some of the leg members 34 to pivot in one direction and others to pivot in the other direction. Rather, they must all move substantially together and in the clockwise direction, viewing any of FIGS. 1, 2, 5, and 7.

Figure 14:
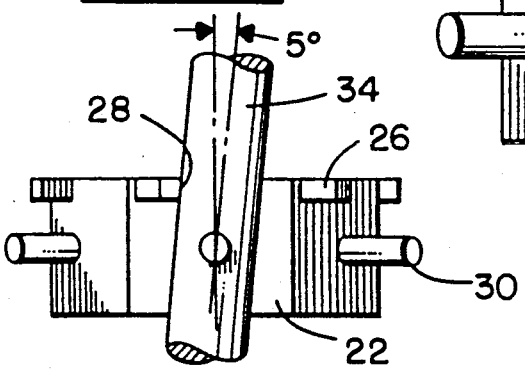
FIG. 14 is a side elevation view similar to FIG. 5 but illustrating another embodiment thereof.

However, it may be desired to construct the drying rack 20 in such a manner that when the leg members 34 are in their fully collapsed positions, the longitudinal axis of each leg member 34 is slightly angularly disposed relative to the central axis. Thus, as seen in FIG. 14, a longitudinal axis of the leg member 34 is seen to assume an angular deviation of five degrees, in a typical construction, relative to the central axis of the core member 22 when the leg member 34 abuts the stop surface 28 of its associated stop member 26. With such a construction, the drying rack 20 even more readily assumes the extended position by reason of gravitational forces. By reason of this construction it is only necessary for the user to hold one leg member 34 and all of the remaining leg members will automatically, without further urging on the part of the user, pivot or swing to an extended position as illustrated in FIGS. 1 and 2.

Accordingly, an inexpensive, lightweight, compact, and highly efficient drying rack has been disclosed which can be readily altered from a collapsed position for storage to an extended position for use with minimal effort. The drying rack utilizes inexpensive materials, a small number of parts, and can be of value to a broad range of the population, whether young adults in an apartment setting, senior citizens with mobile homes, or just about anyone else.

While the preferred embodiments of the invention have been disclosed in detail, it should be understood by those skilled in the art that various modifications may be made to the illustrated embodiments without departing from the spirit and scope thereof as described in the specification and defined in the appended claims.

What I claim is:

1. A collapsible rack for drying clothing and other articles comprising:

a core member having a central axis and including a plurality of stop members extending radially outwardly from said central axis at equally spaced peripheral locations;

a plurality of mounting pins fixed to said core member at equally spaced peripheral locations adjacent said stop members and extending radially outwardly therefrom and terminating at tip ends and lying substantially in a plane perpendicular to said central axis;

a plurality of elongated leg members of substantially equal length extending between opposed ends, said leg members being pivotally mounted on said mounting pins at substantially similar locations intermediate said ends for movement between collapsed and extended positions, each of said leg member being engaged with an associated one of said stop members when it assumes the collapsed position and angularly disposed relative to said central axis when it assumes the extended position;

flexible elongate material of substantially equal length extending between each successive one of said leg members and joined to each of said leg members at substantially similar distances from said mounting pins, said elongate material being substantially taut when said leg members assume their extended positions, said elongate material being limp when said leg members assume their collapsed positions; and retention means for retaining said leg members on said mounting pins while permitting movement of said leg members between their extended and collapsed positions, said retention means including an elongated band member having first and second opposed ends and a plurality of spaced apertures therein, said band member encircling said leg members adjacent said core member, each of the apertures in said band member positioned to receive an associated one of said tip ends of said mounting pins, said first and second opposed ends being caused to overlap such that the apertures adjacent said ends are fittingly received on a same one of said mounting pins, said band member being sized to bias said leg members into engagement with said core member.

2. A collapsible drying rack as set forth in claim 1 wherein each of said leg members is substantially parallel to said central axis when it assumes the collapsed position.

3. A collapsible drying rack as set forth in claim 1 wherein each of said leg members is slightly angularly disposed relative to said central axis when it assumes the collapsed position engaged with its associated one of said stop members;

wherein the angle between the longitudinal axis of each of said leg members in the extended position and said central axis is no greater than ninety degrees; and wherein the longitudinal axis of each of said leg members in the collapsed position lies intermediate its longitudinal axis in the extended position and said central axis.

4. A collapsible drying rack as set forth in claim 1 including:

a pair of pegs having enlarged extremities fixed to said band member and extending transversely thereof at spaced apart longitudinal locations adjacent said first end thereof, said pegs being fittingly receivable in a pair of similarly spaced holes formed in said band member adjacent said second end thereof.

5. A collapsible rack for drying clothing and other articles comprising:

a core member having a central axis and including a plurality of stop members extending radially outwardly from said central axis at spaced peripheral locations;

a plurality of mounting pins fixed to said core member at equally spaced peripheral locations adjacent said stop members and extending radially outwardly therefrom and terminating at tip ends and lying substantially in a plane perpendicular to said central axis;

a plurality of elongated leg members extending between upper and lower ends, said leg members being pivotally mounted on said core member intermediate said ends for movement between collapsed and extended positions, each of said leg members being engaged with an associated one of said stop members when it assumes the collapsed position, each of said leg members being angularly disposed relative to said central axis when it assumes the extended position, each of said leg members being pivotally mounted on an associated one of said mounting pins; and wherein each of said leg members is of uniform diameter and has a transverse bore intermediate said ends for slidable reception on said associated mounting pin;

wherein each of said mounting pins is longer than the diameter of each of said leg members so as to protrude from the outer surface of its associated one of said leg members when said leg member is engaged against said core member; retention means for retaining said leg members on said mounting pins while permitting movement of said leg members between their extended and collapsed positions, said retention means including an elastic band member having a plurality of spaced apertures therein, said band member encircling said leg members adjacent said core member, each of the apertures in said band member positioned to receive an associated one of said tip ends of said mounting pins, said band member being sized to bias said leg members into engagement with said member; and flexible elongate material extending between each successive one of said leg members and joined thereto, said elongate material being substantially taut when said leg members assume their extended positions, said elongate material being limp when said leg members assume their collapsed positions.

6. A collapsible drying rack as set forth in claim 5 wherein each o said leg members is substantially parallel to said central axis when it assumes the collapsed position.

7. A collapsible drying rack as set forth in claim 5 wherein each of said leg members is slightly angularly disposed relative to said central axis when it assumes the collapsed position engaged with its associated one of said stop members;

wherein the angle between the longitudinal axis of each of said leg members in the extended position and said central axis is no greater than ninety degrees; and wherein the longitudinal axis of each of said leg members in the collapsed position lies intermediate its longitudinal axis in the extended position and said central axis.

8. collapsible drying rack as set forth in claim 5 wherein said stop members extend radially outwardly from said central axis at equally spaced peripheral locations.

9. A collapsible drying rack as set forth in claim 5 including:

hanger means on at least one of said leg members for suspending articles to be dried.

10. A collapsible drying rack as set forth in claim 9 wherein said hanger means includes:

a ring member fittingly received on said leg member; and a peg member integral with said ring member and projecting away therefrom so as to face toward said central axis.

11. A collapsible drying rack as set forth in claim 9 wherein said hanger means includes:

a plurality of ring members fittingly received on each of said leg members at spaced locations; and a lower peg member integral with each of said ring members and projecting away therefrom so as to face toward said central axis.

12. A collapsible drying rack as set forth in claim 5 wherein said lower ends of said leg members are supported on a surface when said leg members are unattended and assume the extended position; and including a net member for receiving thereon articles to be dried, said net member being releasably mounted on said upper ends of said leg members and lying in a plane generally transverse of said central axis.

13. A collapsible drying rack as set forth in claim 12 wherein said upper end of each of said leg members includes an integral upper peg member extending away therefrom;

wherein said net member has a peripheral edge and includes:

said peripheral edge at spaced peripheral locations for reception on said upper peg members;

whereby said net member provides a supporting surface for articles to be dried.

14. A collapsible drying rack as set forth in claim 5 including:

an extension pole releasably mounted to said core member generally aligned with said central axis and extending in a direction away from said lower ends.

15. A collapsible drying rack as set forth in claim 14 including:

hanger means on said extension pole for suspending articles to be dried.

16. A collapsible drying rack as set forth in claim 15 wherein said hanger means includes:

at least one ring member fittingly received on said extension pole; and a peg member integral with said ring member and projecting away therefrom.

17. A collapsible rack for drying clothing and other articles comprising:

a core member having a central axis and including integral stop means thereon;

a plurality of elongated leg members extending between opposed ends, said leg members being pivotally mounted don said core member intermediate said ends for movement between collapsed positions engaged with said stop means and extended positions disengaged therefrom;

hanger means on at least one of said leg members for suspending articles to be dried;

flexible elongate material of substantially equal length extending between each successive one of said leg members and joined to each of said leg members at substantially similar distances from said mounting pins, said elongate material being substantially taut when said leg members assume their extended positions, said elongate material being limp when said leg members assume their collapsed positions; and retention means engageably encircling said leg members for retaining said leg members on said mounting pins while permitting movement of said leg members between their extended and collapsed positions.

18. A collapsible drying rack as set forth in claim 17 wherein said stop means includes a plurality of stop members on said core member extending radially outwardly from said central axis at equally spaced peripheral locations; and wherein said retention means is an elastic band member.

19. A collapsible drying rack as set forth in claim 18 wherein each of said leg members is slightly angularly disposed relative to said central axis when it assumes the collapsed position engaged with its associated one of said stop members;

wherein the angle between the longitudinal axis of each of said leg members in the extended position and said central axis is no greater than ninety degrees; and wherein the longitudinal axis of each of said leg members in the collapsed position lies intermediate its longitudinal axis in the extended position and said central axis.

20. A collapsible rack for drying clothing and other articles comprising:

a core member having a central axis;

a plurality of mounting pins fixed to said core member at equally spaced peripheral locations and extending radially outwardly therefrom and terminating at tip ends and lying substantially in a plane perpendicular to said central axis;

a plurality of elongated leg members of substantially equal length extending between opposed ends, said leg members being pivotally mounted on said mounting pins at substantially similar locations intermediate said ends for movement between collapsed and extended positions, each of said leg members being angularly disposed relative to said central axis when it assumes the extended position; flexible elongate material of substantially equal length extending between each successive one of said leg members and joined to each of said leg members at substantially similar distances from said mounting in said elongate material being substantially taut when said leg members assume their extended positions, said elongate material being limp when said leg members assume their collapsed positions; and retention means engageably encircling said leg members for retaining said leg members on said mounting pins while permitting movement of said leg members between their extended and collapsed positions.

21. A collapsible clothes drying rack as set forth in claim 20 wherein each of said leg members is substantially parallel to said central axis when it assumes the collapsed position; and wherein said retention means is an elastic band member.

22. A collapsible clothes drying rack as set forth in claim 20 wherein each of said leg members is of uniform diameter and has a transverse bore intermediate said ends for slidable reception on said associated mounting pin;

wherein each of said mounting pins is longer than the diameter of each of said leg members so as to protrude from the outer surface of its associated one of said leg members when said leg member is engaged against said core member; and wherein said retention means includes an endless elastic band member having a plurality of spaced apertures therein, said band member encircling said leg members adjacent said core member, each of the apertures in said band member positioned to receive an associated one of said tip ends of said mounting pins, said band member being sized to bias said leg members into engagement with said core member.

23. A collapsible clothes drying rack as set forth in claim 20 including: hanger means on at least one of said leg members for suspending articles to be dried.

24. A collapsible, clothes drying rack as set forth in claim 20 including:

an extension pole releasably mounted to said core member generally aligned with said central axis and extending in a direction away from said lower ends; and hanger means on said extension pole for suspending articles to be dried.

25. A collapsible drying rack as set forth in claim 20 wherein said lower ends of said leg members are supported on a surface when said leg members are unattended and assume the extended position; and including a net member for receiving thereon articles to be dried, said net member being releasably mounted on said upper ends of said leg members and lying in a plane generally transverse of said central axis.

* * * * *